US006077169A

United States Patent [19]

Florian

[11] Patent Number: 6,077,169

[45] Date of Patent: Jun. 20, 2000

[54] PORTABLE INSTRUCTIONAL GOLF STATION

[76] Inventor: Raymond J. Florian, 14440 Elwell, Belleville, Mich. 48111

[21] Appl. No.: 09/233,227

[22] Filed: Jan. 19, 1999

[51] Int. Cl.[7] ..... A63B 57/00

[52] U.S. Cl. ..... 473/278; 473/270

[58] Field of Search ..... 473/270, 273, 473/278, 279

[56] References Cited

U.S. PATENT DOCUMENTS

| | | | |
|---|---|---|---|
| 3,770,280 | 11/1973 | Straus | 473/209 |
| 4,248,431 | 2/1981 | Burnes | 473/270 |
| 4,346,896 | 8/1982 | Russell et al. | 473/279 |
| 4,355,810 | 10/1982 | Rydeck | 473/218 |
| 4,736,952 | 4/1988 | Taft et al. | 473/273 X |
| 4,805,913 | 2/1989 | Bott | 473/270 X |
| 4,875,685 | 10/1989 | Ballinger et al. | 473/279 |
| 4,915,387 | 4/1990 | Baxstrom | 473/270 |
| 5,478,082 | 12/1995 | De Knight et al. | 473/270 X |
| 5,645,494 | 7/1997 | Dionne et al. | 473/270 X |
| 5,976,027 | 11/1998 | Kachmar | 473/273 |

FOREIGN PATENT DOCUMENTS

| | | | |
|---|---|---|---|
| 1494475 | 12/1977 | United Kingdom | 273/195 R |

*Primary Examiner*—Jeanette Chapman
*Assistant Examiner*—Mitra Aryanpour
*Attorney, Agent, or Firm*—Charles W. Chandler

[57] ABSTRACT

A golf driving instructional station includes a portable platform equipped with a golf ball support mat, a golf club selector mat, and a shoe-support mat. The golf club selector mat has markings that can be used to select different golf clubs for use with the instructional station. The shoe support mat has shoe-positioner markings that enable the golfer to position his feet correctly when swinging different golf clubs against a golf ball located on the golf ball support mat. Reference markings on the golf club selector mat permit the golfer to reposition the shoe support mat to a proper position for each particular golf club.

7 Claims, 3 Drawing Sheets

PORTABLE INSTRUCTIONAL GOLF STATION

BACKGROUND OF THE INVENTION

This invention is related to a portable practice golf driving range tee mat, and more particularly to a platform having a first high tech grass mat from which the ball is driven. A second mat, on which the golfer places his feet, cooperates with a third mat in locating the golfer's feet with respect to the striking position of the ball, depending upon the club being swung.

Golfers are concerned with the proper location of their feet when holding a club for striking a ball. Proper foot placement depends upon several factors. A primary factor is the nature of the club being swung, that is, whether it is an iron or a wood club, and further what type of iron or wood club is being swung. Typically a wood club requires a wider stance than an iron used for chipping or pitching. Further, the distance the golfer places his feet from the ball depends upon the nature of the club. An iron or a wedge requires a closer stance than a wood or a driver.

SUMMARY OF THE INVENTION

The broad purpose of the present invention is to provide a portable instructional golf driving range tee mat for a golfer to practice swinging various clubs toward a ball on a structured and simulated fairway or golf tee while properly locating his feet with respect to the ball.

The preferred embodiment of the invention employs a portable folding platform. A simulated high tech mat is attached along one side of the portable platform and may be of the type illustrated and described in my pending U.S. patent application Ser. No. 09/132,588, filed Aug. 11, 1998.

The practice ball is placed on the simulated grass and the tee.

A second moveable mat is placed adjacent the fairway mat in a position that the golfer occupies while swinging the club. The second mat has a profile indicating the appropriate location of the golfer's left foot and his right foot when swinging various clubs.

A third mat, alongside the second mat, has visible markings, which depend upon the nature of the club being swung, and which cooperate with the second mat to define the distance the golfer stands with respect to the ball. The user can make minor modifications with the mats depending upon his personal physical characteristics, that is whether he is tall or short. When not being used, the three mats may be carried inside the folded platform and stored in a suitable location.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
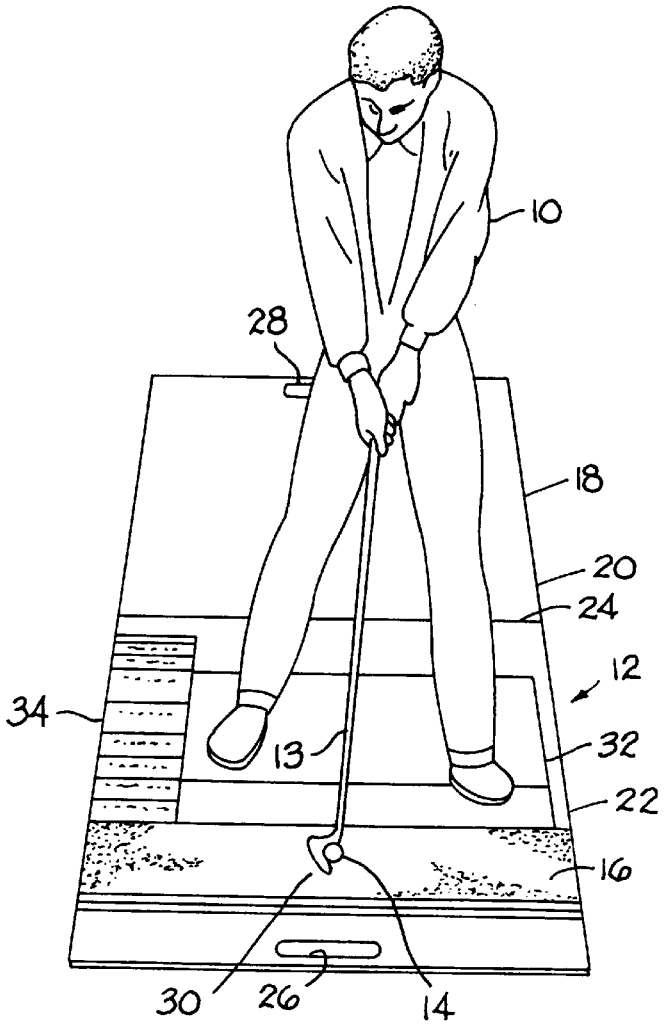
FIG. 1 is a view illustrating a golfer with a club and a ball on an instructional green illustrating the preferred embodiment of the invention.

FIG. 1 illustrates a golfer 10 standing on an instructional golf station 12 illustrating the preferred embodiment of the invention. The golfer is illustrated aligning a club 13 for striking a practice golf ball 14 mounted on an elongated golf ball support mat 16 simulating a golf fairway or tee area. Ball 14 is a simulated ball formed of a lightweight material such as crushed newspaper wrapped in duct tape.

Figure 4:
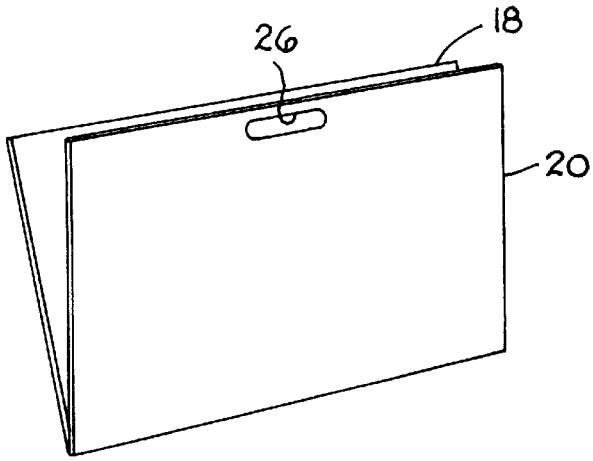
FIG. 4 is a view of the folded platform.

Fairway mat 16 is elongated preferably measuring about 9½ inches wide by 47 inches long and is attached to a wooden platform 18 comprising a pair of halves 20 and 22 connected by a hinge means 24. The platform is illustrated in FIG. 4 in its folded position. Platform half 22 has a handle-gripping opening 26, and platform half 20 has a handle-gripping opening 28 which is aligned with opening 26 when the platform is folded as illustrated in FIG. 4. The platform is ¼ inches thick, and when unfolded measures approximately 48 inches wide by 50 inches long.

Fairway or golf tee mat 16 has a simulated grass material on its top surface on which the ball is placed in a ball-striking position 30. Mat 16 preferably comprises a multi-layer structure in which the top layer, containing the simulated grass, is horizontally resiliently moveable when the club strikes the green. This is more fully explained in my co-pending patent application. Mat 16 may also take other simulated grass forms.

A pair of moveable foot-locating mats 32 and 34 is mounted on the platform adjacent mat 16. Mat 32 is disposed in position that the golfer places his feet when swinging the club. As will be seen from FIGS. 1 and 2, mat 32 is of sufficient area to form a supporting surface for the golfer's shoes.

Figure 2:
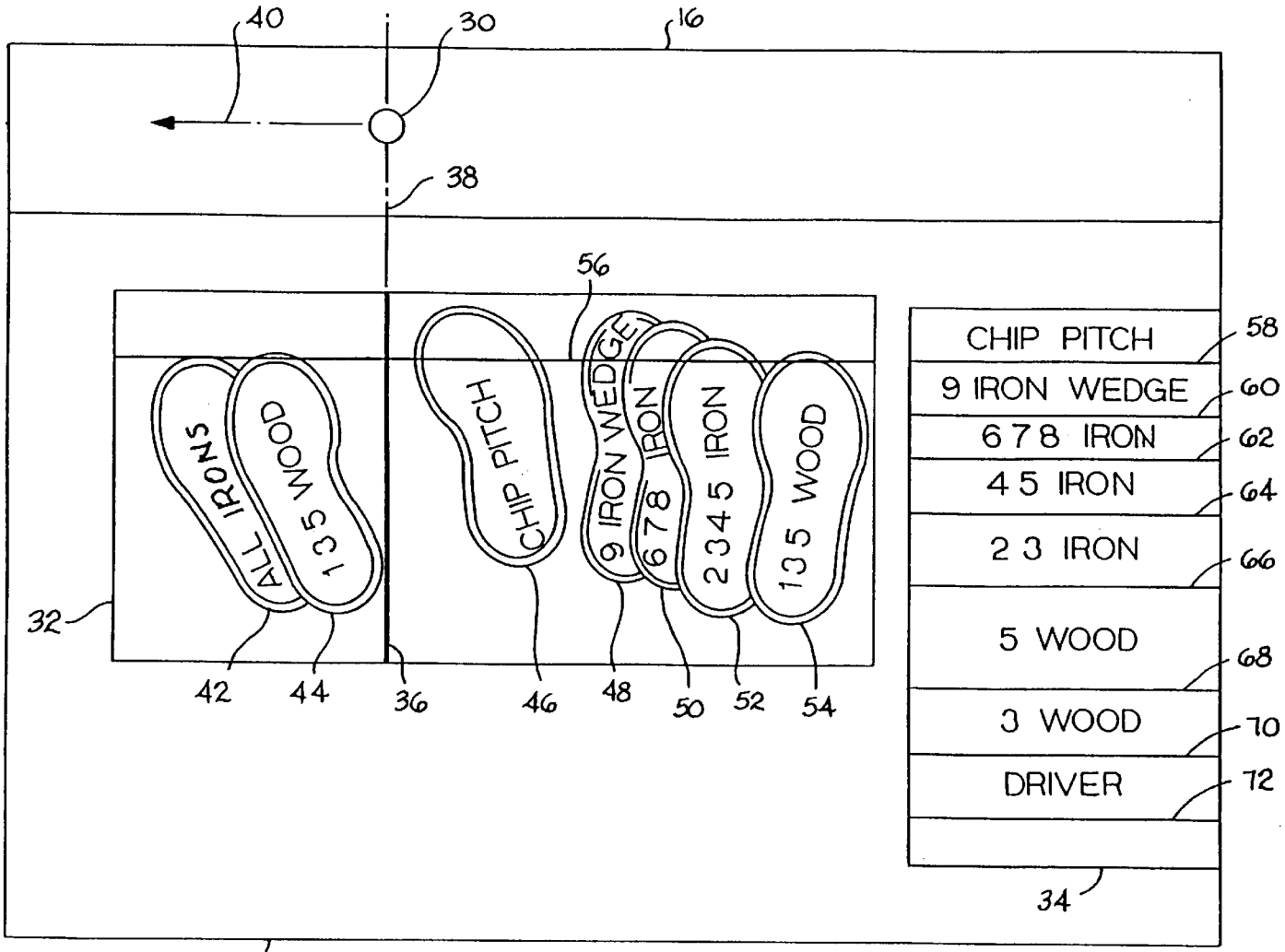
FIG. 2 is a view of the two foot locating mats located for guiding the golfer in using an iron club.

Referring to FIG. 2, mat 32 is somewhat flexible, is formed of a suitable rubber type material and has a sufficient rigidity to lay flat on the platform. Mat 32 is elongated and has a linear alignment marking 36 that is aligned along an axis 38 to intersect ball-striking position 30, preferably at right angles to the direction 40 along which the ball is intended to be struck.

Mat 32 also has the profiles 42 and 44 of a pair of feet for locating the left foot of the golfer depending upon whether he is using an iron club or a wood club. The profiles may be stenciled marks on the top surface of the mat. Profile 42 is used for swinging an iron while profile 44 is used for striking the woods.

Mat 32 on the other side of marking 36 has profiles 46, 48, 50, 52, and 54 of a foot for locating the position in which the golfer is to place his right foot which, in turn, depends on the characteristics of the particular club he is swinging. For example, profile 46 indicates where he is to place his right foot when using an iron for a chipping motion; profile 48 is used with either a 9 iron or a wedge; profile 50 is used for locating his right foot for either a 6, 7 or 8 iron; profile 52 is used for locating his foot when swinging either a 2, 3, 4 or 5 iron while profile 54 locates his right foot for swinging a 1, 3 or 5 wood.

Mat 32 also has a second linear alignment marking 56, which is at right angles to and intersects marking 36. Mat 32 is disposed so that marking 56 is generally parallel to the ball's path of motion 40.

Mat 34 is also elongated and mounted along the right side of the platform. Mat 34 has six parallel stenciled lines 58, 60, 62, 64, 66, 68, 70 and 72 each located according to the distance striking characteristics of one or more clubs. Parallel lines 58 through 72 are disposed at an increasing distance from the fairway mat, and are parallel to ball direction 40. The particular line being used depends upon the characteristics of the club being swung. For example, the golfer would employ line 58 for a chip or pitching swing; line 60 for a 9 iron or wedge; line 62 for a 6, 7 or 8 iron; line 64 for a 4 or 5 iron; line 66 for a 2 or 3 iron; line 68 for a 5 wood; line 70 for a 3 wood, and line 72 for a driver. Mat 34 may be considered to be a golf club selector mat, in that markings 58 etc. enable the golfer to select different golf clubs during use of golf station 12.

The two mats cooperate in defining the position of the golfer's feet by aligning marking 56 on mat 32 with the appropriate line 58 to 72 on mat 34 determined by the particular club that he is swinging. When the two mats are properly lined up as illustrated in FIG. 2, he is then in a position for either a chipping or pitching swing.

Figure 3:
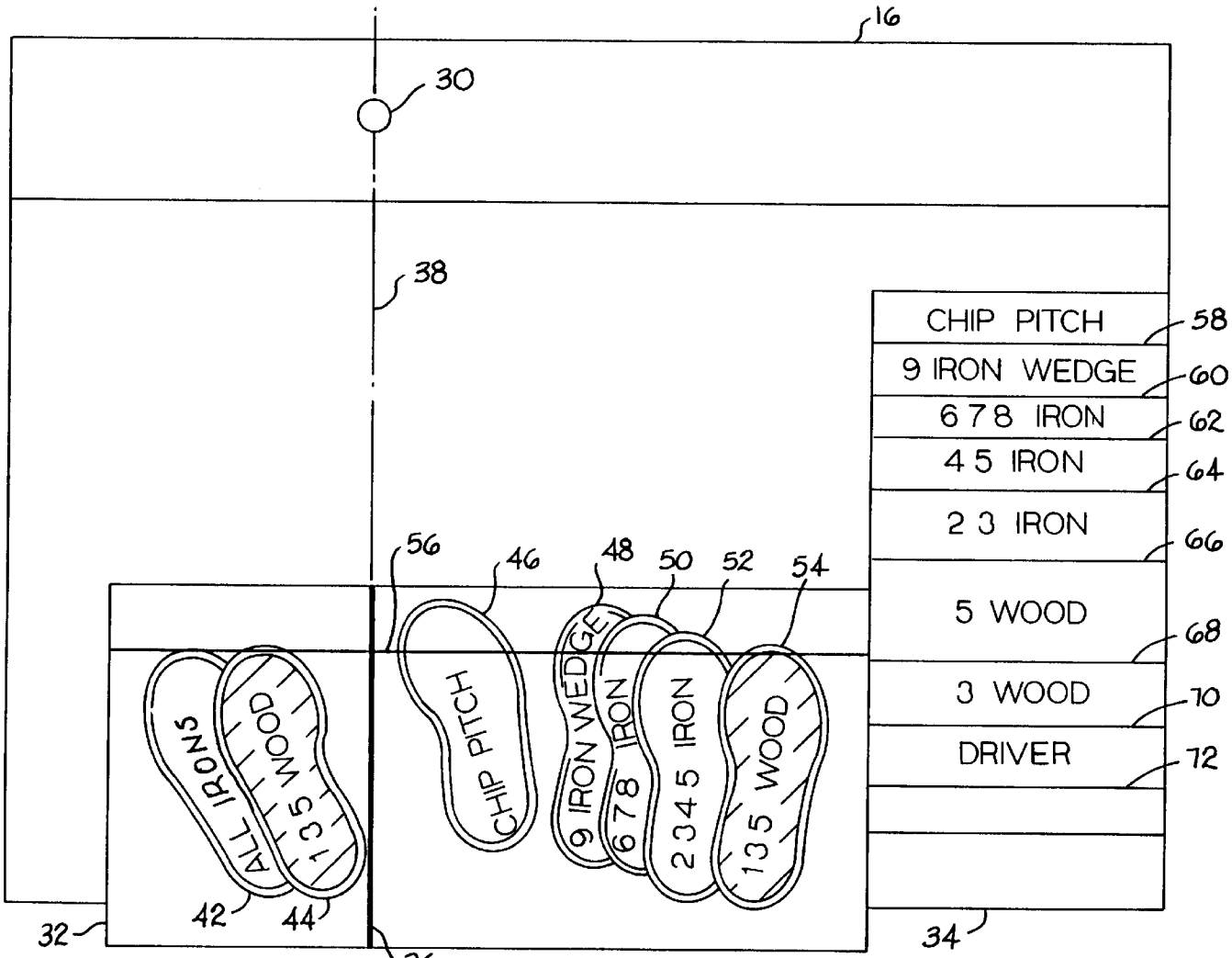
FIG. 3 is a view similar to FIG. 2, but showing the location of the two mats when the golfer is swinging a wood club.

FIG. 3 shows the position the golfer employs for swinging a 5 wood. In this case, the mat has been placed a greater distance from ball position 30 with line 56 aligned with line 68. His left foot is placed on profile 44 and his right foot placed on profile 54, which are shaded for illustrative purposes. Line 56 is lined up to form a linear extension of line 68 while marking 36 is aligned along the imaginary line 38 to intersect the center of the ball-striking position 30. If the ball is placed in a different location on mat 16, the location of the golfer's two feet is adjusted accordingly.

The golfer can make minor adjustments to the location of his feet by adjusting the position of the two mats with respect to the ball-striking position.

Having described my invention, I claim:

1. A portable golf driving teaching aid, comprising:

a flat portable platform (18);

a first golf ball support mat (16) locatable on said platform;

said first mat having a ball position marking (30) that establishes a line (38) extending from said ball position marking along a line normal to the intended motion path for a golf ball;

a second golf club selector mat (34) locatable on said platform; said second mat having plural golf club identifier lines (58 etc) spaced along an imaginary line normal to the intended motion path of the golf ball so that each club identifier line is a different distance from the intended motion path of the golf ball;

a third shoe-support mat (32) removably positionable on said platform in near adjacency to said second mat; said third mat having markings thereon designating various shoe positions to be used with a different golf club; said third mat having a linear marking (36) alignable with said ball position marker along a line normal to the intended motion path of the golf ball, so that the designated shoe positions are oriented to the golf ball position marker (30) in a direction taken along the intended motion path of the golf ball; said third mat having a golf club reference line (56) extending normal to said linear marking;

said third mat being repositionable on said platform in a direction parallel to said linear marking so as to selectively align said golf club reference line with different ones of the golf club identifier lines on said second mat; and said second golf club selector mat being repositionable on said platform in a direction normal to the intended motion path of the golf club, such that each club identifier line has a variable spacing from the intended motion path of the golf ball.

2. The teaching aid as defined in claim 1, and further comprising club identifier indicia located alongside each said club identified line on said golf club selector mat; said indicia being of sufficient size as to be readily visible to a person standing on said shoe-support mat.

3. The teaching aid as defined in claim 1 and further comprising club identifier indicia proximate each said club identifier line on said golf club selector mat; said indicia being of sufficient size as to be readily visible to a person standing on said shoe-support mat.

4. The teaching aid as defined in claim 1, wherein said shoe position markings take the form of shoe sole outlines printed on said shoe-support mat.

5. The teaching aid as defined in claim 4, wherein said shoe sole outlines include a set of shoe sole outlines for the golfer's left foot and a set of shoe sole outlines for the golfer's right foot.

6. The teaching aid as defined in claim 5, wherein said linear marking (36) is located between the two sets of shoe sole outlines.

7. The teaching aid as defined in claim 6, and further comprising club identifier indicia located within each shoe sole outline for indicating the golf club that is to be used with each respective shoe outline.

* * * * *